United States Patent [19]

Terreri

[11] Patent Number: 4,685,254

[45] Date of Patent: Aug. 11, 1987

[54] SWIMMING POOL COVER SUPPORT, COVERED SWIMMING POOL AND METHOD OF COVERING A SWIMMING POOL

[76] Inventor: Claude J. Terreri, 324 Tanner Marsh Rd., Guilford, Conn. 06437

[21] Appl. No.: 823,723

[22] Filed: Jan. 29, 1986

[51] Int. Cl.[4] ..... E04H 3/16

[52] U.S. Cl. ..... 52/2; 52/63; 4/499

[58] Field of Search ..... 52/2, 63; 4/499–503

[56] References Cited

U.S. PATENT DOCUMENTS

| | | | |
|---|---|---|---|
| 3,063,062 | 11/1962 | Logan | 4/503 |
| 3,355,745 | 12/1967 | Jannuzzi | 4/503 |
| 3,366,977 | 2/1968 | Koehler | 4/499 |
| 3,533,110 | 10/1970 | Gisondi | 4/499 |
| 3,801,994 | 4/1974 | Brown | 4/499 |
| 3,940,809 | 3/1976 | Hughes | 4/499 |
| 4,109,325 | 8/1978 | Shuff | 4/499 |

*Primary Examiner*—James L. Ridgill, Jr.
*Attorney, Agent, or Firm*—Richard A. Craig

[57] ABSTRACT

A pool cover support comprises a balloon for placement in its uninflated condition on the surface of the water in a swimming pool, an air hose having one end attached to the balloon and provided at its other end with a valve. The hose is of sufficient length that when the balloon is secured in a predetermined position, the valve can be located outside the pool, whereby the balloon can be inflated or later deflated.

A covered pool has an edge and is filled with water. A pool cover covers the pool and overlaps the pool's edge, and a pool cover support comprises a balloon which is in a predetermined position on the water and underneath the cover, an air hose having one end attached to the balloon and a valve at its other end. The hose is sufficiently long that the valve is outside the pool, whereby the balloon can be inflated or later deflated with the cover in place.

A method of covering a pool utilizes a cover support including a balloon and comprises the steps of placing a cover over the pool and the balloon and thereafter pumping air into the balloon to change same to its inflated condition.

9 Claims, 5 Drawing Figures

SWIMMING POOL COVER SUPPORT, COVERED SWIMMING POOL AND METHOD OF COVERING A SWIMMING POOL

BACKGROUND OF THE INVENTION

This invention relates to a swimming pool cover support, a covered swimming pool, and to a method of covering a swimming pool.

More particularly, the invention relates to a cover support for an above ground swimming pool and to a method of covering such a pool.

The usual winterizing procedure for a swimming pool involves cleaning the pool, applying chemicals to keep the water free from algae and bacteria, the chemicals also including an antifreezing agent to keep the water from freezing with the concomitant expansion of the ice which could burst the pool. An inflated plastic balloon is then placed on the surface of the water and secured in place at the center of the pool. Then, a cover, such as a tarpaulin, is pulled over the inflated balloon. When the tarpaulin is finally manipulated into its final position, it is secured in place by tying or anchoring same to the side and/or the deck of the pool.

The manipulation of the cover number into its final position, over the inflated balloon, is a difficult, time-consuming, exasperating task, which is so onerous that sometimes the pool is left uncovered, with disastrous results.

An important object of the invention is to eliminate the necessity of manipulating the cover member into place over the inflated ballon, which may extend 5 to 6 feet (152 to 188 cm.) above the surface of the water.

A novelty search has revealed the following U.S. Patents:

| | | | | |
|---|---|---|---|---|
| 3,063,062 | issued | November 13, 1962 | to | Logan; |
| 3,355,745 | issued | December 5, 1967 | to | Jannuzzi; |
| 3,533,110 | issued | October 13, 1970 | to | Gisondi; |
| 3,940,809 | issued | March 2, 1976 | to | Hughes; and |
| 4,109,325 | issued | August 29, 1978 | to | Shuff. |

Of these, only the Januzzi Patent appears pertinent to the present invention, and even in that instance, the pertinence is only that it discloses the problem which the present invention has solved. The Jannuzzi Patent discloses an air-filled cover support in the form of a balloon which is placed on the surface of water in a pool. The user then places a cover over the pool, including the inflated balloon. The cover is a rot-proof, chlorine-proof fabric or other suitable piece of material.

The present invention is an improvement over the teaching of the Jannuzzi Patent.

SUMMARY OF INVENTION

A pool cover support embodying the invention comprises a balloon for placement in its uninflated condition on the surface of the water in a swimming pool, an air hose having one end attached to the balloon and provided at its other end with a valve. The hose is of sufficient length that when the balloon is secured in a predetermined position, the valve can be located outside the pool, whereby the balloon can be inflated or later deflated.

A covered pool embodying the invention has an edge and is filled with water. A pool cover covers the pool and overlaps the pool edge, and a pool cover support comprises a balloon which is in a predetermined position on the water and is underneath the cover, an air hose having one end attached to the balloon and a valve at the other end of the hose. The hose is sufficiently long that the valve is outside the pool, whereby the balloon can be inflated or later deflated with the cover in place.

A method of covering a pool utilizes a cover support including a balloon and comprises the steps of placing the balloon in its uninflated condition on the surface of water in the pool, placing a cover over the pool and the balloon and thereafter pumping air into the balloon to change same to its inflated condition.

DESCRIPTION OF THE INVENTION

Figure 1:
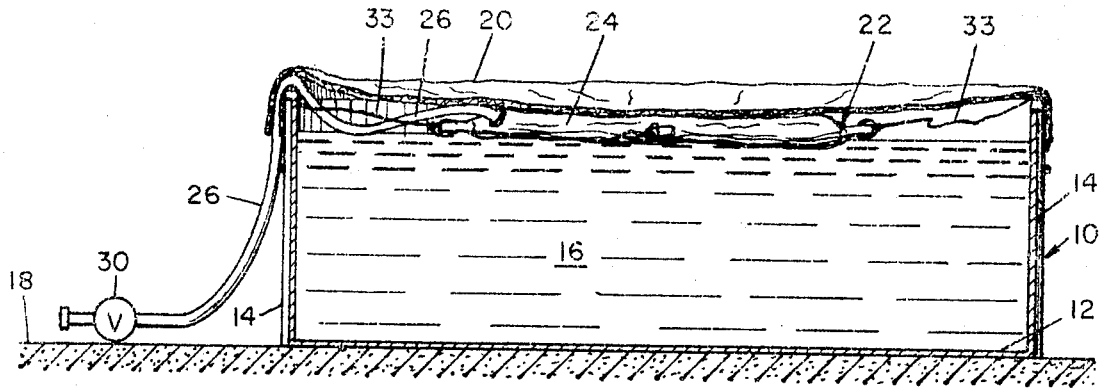
FIG. 1 is a transverse sectional view of a pool with a pool cover affixed to the side of the pool, and, on the surface of the water and underneath the pool cover, a preferred pool cover support in the uninflated condition.
Figure 2:
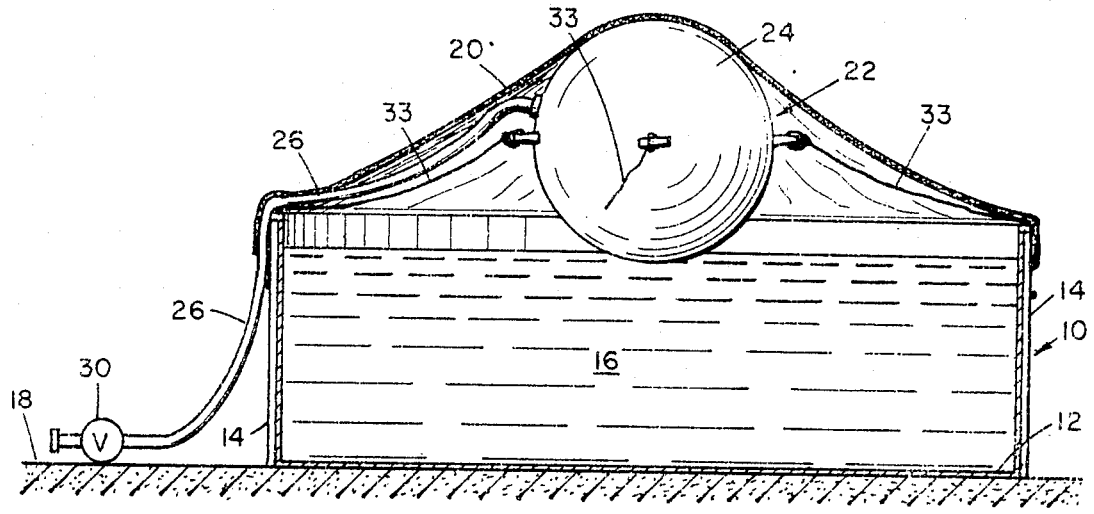
FIG. 2 is a view similar to FIG. 1 but showing the pool cover support in the inflated condition.
Figure 3:
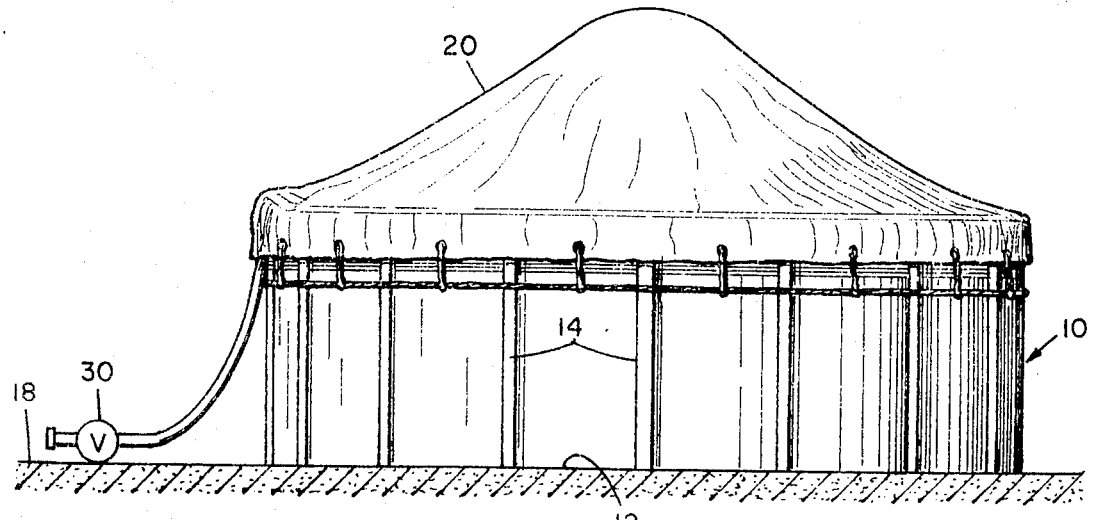
FIG. 3 is a view similar to FIG. 2 but showing in elevation the pool and the pool cover with the pool cover support in the inflated condition but invisible.

FIGS. 1, 2, and 3 show a round pool 10 having a liner 12 providing a bottom and a cylindrical side 12 of pool 10. Liner 12 is supported by circularly arranged posts 14 and pool 10 is filled with water 16 to a predetermined level. Pool 10 is of the above ground type and is shown on ground 18.

Pool 10 is provided with a cover 20 which is of suitable waterproof fabric and is on the order of a tarpaulin.

A cover support 22 is on the surface of water 16 and underneath cover 20. Cover support 22 embodies the invention and comprises a balloon 24 which, when inflated as shown in FIG. 2, is substantially spherical.

Figure 4:
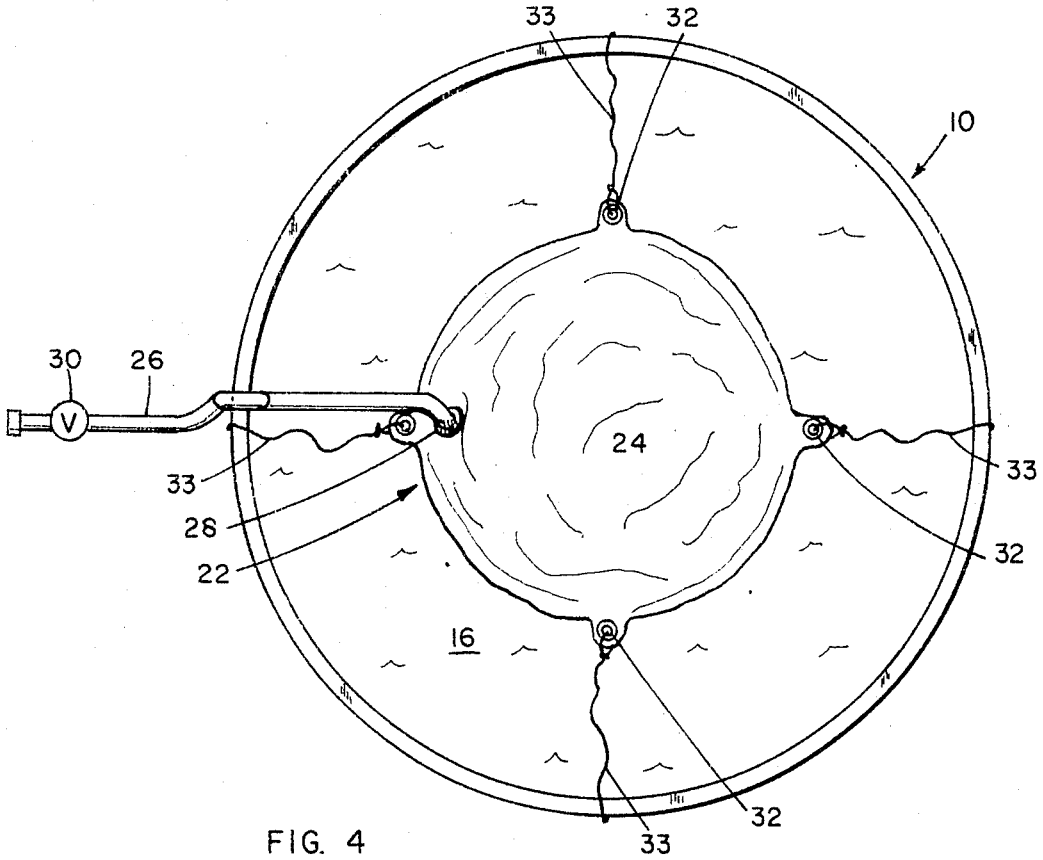
FIG. 4 is a plan view of the pool cover support of FIGS. 1, 2, and 3 in the uninflated condition on the surface of the water in the pool.

Cover support 22 is shown on the surface of water 16 in pool 10 in FIG. 4 with balloon 24 in the uninflated condition. Support 22 also comprises an air hose 26, one end of which is attached as by bonding to balloon 24 at 28 (FIG. 4) and the other end of which is provided with a valve 30. Hose 26 is of sufficient length that when balloon 24 is on the surface of water 16 in the center of pool 10, valve 30 can be located outside pool 10.

Cover support 22 further comprises grommets 32 on balloon 24 (FIG. 4), grommets 32 providing means for securing support 22 on the surface of water 16 in the center of pool 10.

To install cover 20 on pool 10, support 22 is placed with balloon 24 in the uninflated condition on the surface of water 16 and secured in place by cords 33 which pass through grommets 32, with hose 26 extending from balloon 24 to a location outside of pool 10. By "uninflated condition" is meant a condition substantially less than fully inflated.

Cover 20 is then placed over the surface of water 16, with balloon 24 between cover 20 and water 16 with the edge of cover 20 extending over the edge of pool 10 and secured in place in known fashion.

Balloon 24 is then inflated to complete the installation by passing air from outside pool 10, via valve 30 and hose 26 until the final condition shown in FIGS. 2 and 3 is reached. In this condition, the center of cover 20 is elevated so that snow, ice and leaves tend to slide off cover 20.

Figure 5:
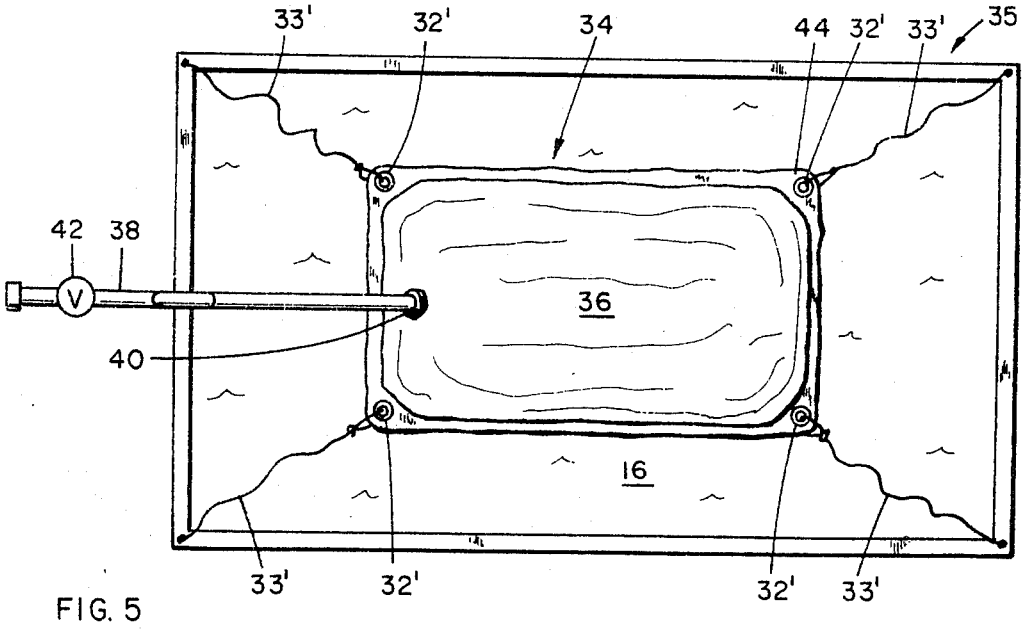
FIG. 5 is a view similar to FIG. 4 but showing a modified pool cover support on the surface of the water in a modified pool.

FIG. 5 shows in uninflated condition a modified cover support 34 on the surface of water 16 in a rectangular pool 35. Support 34 comprises a rectangular balloon 36 and an air hose 38, one end of which is bonded to balloon 36 at 40 and the other end of which is provided with a valve 42. Like balloon 24, balloon 36 is provided with grommets 32' and is secured in place by cords 33' which pass through grommets 32'.

The corners of balloon 36 are provided with grommets 44 for use in locating support 34 on the water surface of a rectangular pool. Hose 38 is of sufficient length that when balloon 36 is properly located in its pool, valve 42 can be located outside the pool.

Preferably, balloon 24 or balloon 36 is made of rubber and valve 30 or valve 42 can be either a standard valve as used in automobile tires or a screw shut off valve as used in life jackets or air mattresses if inflation is to be accomplished by mouth or a home vacuum cleaner. Inflation can also be accomplished by a foot operated pump commonly used to inflate automobile tires or a hand pump such as is used to inflate bicycle tires, or by an electric motor driven air compressor.

The invention also has the advantage of enabling ready introduction of additional air into the balloons if air pressure is lost, without having to un-do and re-do the installation in the dead of winter.

It is evident that the invention, both in its article aspect and its method aspect, achieves the stated objects and advantages and others.

The disclosed details are exemplary only and are not to be taken as limitations on the invention except as those details may be included in the appended claims.

What is claimed is:

1. A support for a pool cover placed over the support, said support being separate from the cover and comprising an inflatable balloon for placement in its uninflated condition on the surface of the water in a pool, an air hose having one end attached directly to the balloon and a valve at its other end, the balloon having securing means permitting the balloon to be secured in a predetermined position on the water surface and the hose being of sufficient length that when the balloon is so secured, the other end of the hose and the valve can be located outside the pool, whereby the balloon can be inflated to raise the cover by forcing air into the hose and the balloon through the valve and later deflated to lower the cover by allowing air to escape from the balloon through the hose and the valve.

2. A pool cover support according to claim 1 wherein the securing means is provided by grommets.

3. A pool cover support according to claim 1 wherein the balloon is of rubber.

4. A covered pool having an edge and filled with water to a predetermined level, a pool cover covering the pool and overlapping the pool edge, and a pool cover support separate from said cover and comprising a balloon in a predetermined position on the surface of the water and underneath the pool cover, an air hose having one end attached directly to the balloon and a valve at its other end, the hose extending underneath the cover from the balloon to the valve which is located outside the pool, whereby the balloon can be inflated to raise the cover by forcing air into the hose through the valve and later deflated by allowing air to escape from the balloon through the valve.

5. The combination according to claim 4 wherein the balloon is in its uninflated condition.

6. The combination according to claim 4 wherein the balloon is in its inflated condition.

7. The combination according to claim 4 wherein the balloon is in a condition between its uninflated condition and its inflated condition.

8. A method of covering a pool filled with water to a predetermined level with the aid of a pool cover and a separate pool cover support including a balloon and a hose having one end directly attached to the balloon and a valve at the other end, said method comprising the steps of placing the balloon in its uninflated condition on the surface of the water with the other end of the hose and the valve outside the pool, placing the cover over the pool and the balloon and thereafter pumping air directly into the balloon through the valve and the hose to change the balloon to its inflated condition and raise the cover.

9. A method according to claim 8 including the further step of securing the balloon in a predetermined position on the surface of the water prior to the pumping step.

* * * * *